US005745825A

United States Patent [19]

Okawa et al.

[11] Patent Number: 5,745,825

[45] Date of Patent: Apr. 28, 1998

[54] COLOR IMAGE FORMING DEVICE

[75] Inventors: Yukinari Okawa; Masato Kawashima, both of Kawasaki, Japan

[73] Assignee: Fujitsu Limited, Kanagawa, Japan

[21] Appl. No.: 753,599

[22] Filed: Nov. 27, 1996

[30] Foreign Application Priority Data

Dec. 22, 1995 [JP] Japan ..... 7-335533

[51] Int. Cl.[6] ..... G03G 15/01

[52] U.S. Cl. ..... 399/117; 399/112; 399/116

[58] Field of Search ..... 399/110, 112, 399/116, 117, 125; 206/316.1; 347/138, 152

[56] References Cited

U.S. PATENT DOCUMENTS

| | | | |
|---|---|---|---|
| 4,922,297 | 5/1990 | Kondo | 399/117 |
| 5,014,094 | 5/1991 | Amitani et al. | 399/112 X |
| 5,534,972 | 7/1996 | Ohno | 399/116 X |
| 5,552,857 | 9/1996 | Ishikawa | 347/152 X |

FOREIGN PATENT DOCUMENTS

| | | |
|---|---|---|
| 62-299977 | 12/1987 | Japan . |
| 08-36346 | 2/1996 | Japan . |

*Primary Examiner*—Arthur T. Grimley
*Assistant Examiner*—Sophia S. Chen
*Attorney, Agent, or Firm*—Armstrong, Westerman, Hattori, McLeland & Naughton

[57] ABSTRACT

A color image forming device in which an operator with no special trained experience can easily replace photosensitive bodies one by one without inviting deterioration in print quality due to shear in printing. The color image forming device has photosensitive bodies having rotational shafts parallelized nearly, the photosensitive bodies being driven respectively and rotatably in a box. The color image forming device forms a color image on a transfer paper sheet by transferring sequentially color manifest images developed on the photosensitive bodies on the transfer paper sheets. The color image forming device includes a positioning and fixing implement coupled axially and removably to the front end of the rotational shaft of each of the photosensitive bodies, for positioning and fixing to the box while the end of the rotational shaft is supported rotatably; and a coupling for coupling axially and detachably the rotational shaft on the base side of the photosensitive body with a drive system fixed on the box. The color image forming device is applicable to printers of electro-photographic mode, electrostatic recording mode, or the like.

22 Claims, 7 Drawing Sheets

COLOR IMAGE FORMING DEVICE

BACKGROUND OF THE INVENTION

1) Field of the Invention

The present invention relates to a device which has image forming carriers (photosensitive bodies) and which forms a color image on a sheet-like medium by overlapping and printing sequentially a manifest image (toner image) of each color developed on each of image forming carriers on a sheet-like medium. Particularly, the present invention relates to a technique of realizing facilitating the replacement of each image forming carrier.

2) Description of the Related Art

Electro-photographic printers as color image forming devices, for example, have generally the structure as shown in FIG. 6. The electro-photographic printer 1 consists of a color printing engine 2, paper cassettes 3 and 4, a sheet feeding unit 5, a sheet ejecting unit 6, a sheet stacker 7, a power supply/control unit 8, and other elements.

In the electro-photographic printer 1, the transfer paper sheets (sheet-like medium) 18 to be printed are stored in the sheet cassettes 3 and 4. At a printing operation, the transfer paper sheet 18 is sent out of the sheet feeding unit 5 and then guided by means of the conveying roller 23 along the conveying guide (transfer path) 24 to the color printing engine 2. The transfer paper sheet 18 which is color-printed by the color printing engine 2 (to be described later) is guided via the conveying guide (conveying path) 24 and the sheet ejecting unit 6 and then is ejected into the sheet stacker 7.

The power supply/control unit 8 has the functions of supplying electric power for the operation of the printer 1 to various portions and controlling the whole operation of the printer i including the printing operation of the color printing engine 2.

The printer 1 shown in FIG. 6 includes a double-sided surface mechanism (not shown) that reverses the transfer paper sheet 18 with one surface printed on the side of the sheet ejecting unit 6 to perform the double-sided surface printing on the transfer paper sheet 18 and a conveying guide (conveying path) 24A that again sends the transfer paper sheet 18 reversed by the double-sided mechanism to the color printing engine 2.

Generally speaking, the color printing engine 2 which performs a color printing operation includes four printing units 10Y, 10M, 10C, and 10K, a fixing unit 16, an endless electrostatic transfer belt (a conveying belt such as an electrostatic adsorption belt) 17 of a resin which conveys the transfer paper sheet 18.

The printing unit 10Y is formed of a photosensitive body (a transfer drum, an image forming carrier) 11, a pre-charger 12, an optical unit 13, a developing unit 14, and a transfer roller 15 in order to transfer a toner image (developed image, magnifest image) of yellow (Y) on the transfer paper sheet 18. The printing unit 10M is formed of a photosensitive body (a transfer drum, an image forming carrier) 11, a pre-charger 12, an optical unit 13, a developing unit 14, and a transfer roller 15 in order to transfer a toner image (developed image, manifest image) of magenta (M) on the transfer paper sheet 18. The printing unit 10C is formed of a photosensitive body (a transfer drum, an image forming carrier) 11, a pre-charger 12, an optical unit 13, a developing unit 14, and a transfer roller 15 in order to transfer a toner image (developed image, manifest image) of cyan (C) on the transfer paper sheet 18. The printing unit 10K is formed of a photosensitive body (a transfer drum, an image forming carrier) 11, a pre-charger 12, an optical unit 13, a developing unit 14, and a transfer roller 15 in order to transfer a toner image (developed image, manifest image) of black (K) on the transfer paper sheet 18. The printing units 10Y, 10M, 10C and 10K are arranged substantially in parallel along the transfer belt 17.

The photosensitive body 11 is rotatably driven by means of a drive motor (refer to numeral 25 in FIG. 7). The pre-charger 12 electrostatically charges evenly the surface of the photosensitive body 11. The optical unit 13 projects an image light corresponding to record information (information regarding print data) on the surface of the photosensitive body 11. The optical unit 13 exposes a pattern corresponding to print data on the surface of the photosensitive body 11 to form an electrostatic manifest image.

The developing unit 14 develops an electrostatic manifest image formed on the surface of the photosensitive body 11. In fact, the developing process is performed on the surface of the photosensitive body 11 by supplying toner and then forming a toner image (manifest image, developed image). The transfer rollers 15 are arranged so as to confront the photosensitive bodies 11 via the transfer belt (or the transfer paper sheet 18) 17. The toner image on the photosensitive body 11 is transferred onto the transfer paper sheet 18 by sandwiching the transfer paper sheet 18 conveyed by the transfer belt 17 between the transfer rollers 15 and the photosensitive bodies 11.

Further, when the transfer paper sheet 18 on which a toner image of each color is transferred by means of the printing units 10Y, 10M, 10C and 10K is conveyed, the fixing unit 16 fixes the toner image formed on the transfer paper sheet 18 on the transfer paper sheet 18 thermally, or under pressure, light, or the like.

The transfer belt 17 is endlessly wound around the drive roller 19, the follower roller 20, and tensioning rollers (tensioners) 21 and 22, and is driven by transmitting the rotational drive force of the drive motor (not shown) from the drive roller 19. The transfer paper sheet 18 which is charged by means of the charger (not shown) is electrostatistically adsorbed on the outer surface (the surface confronting the photosensitive body 11) and then is conveyed sequentially to the printing units 10Y, 10M, 10C and 10K.

In order to arrange in order the front ends of plural sheets of transfer paper sheet 18, the resist roller (not shown) is arranged just in front of the image transfer point (the image transfer point made by the photosensitive body 11 and the transfer roller 15) to the transfer paper sheet 18 in each of the printing units 10Y, 10M, 10C and 10K.

In the electro-photographic printer I with the abovementioned structure shown in FIG. 6, the transfer paper sheet 18 is transmitted from the sheet cassette 3 or 4 onto the transfer belt 17 of the color printing engine 2 via the sheet feeding unit 5. Then, the transfer paper sheet 18 is transmitted by means of the transfer belt 17 and then transmitted to the fixing unit 16 after it passes through the printing units 10Y, 10M, 10C and 10K.

When the transfer paper sheet 18 passes through the printing units 10Y, 10M, 10C and 10K, a toner image of each color (Y, M, C, K) is transferred on the transfer paper sheet 18. When the transfer paper sheet 18 passes through the fixing unit 16, the toner image is fixed on the transfer paper sheet 18.

When a printing operation is performed by overlaying sequentially different colors on the transfer paper sheet 18 in the printing units 10Y, 10M, 10C and 10K, a color image is formed on the transfer paper sheet 18. A high-speed printing throughput can be achieved (at 20 sheets/minute or more) by printing with printing units 10Y, 10M, 10C and 10K.

However, by arranging two or more printing units, shear in printing may be synergistically amplified due to the overlap of respective inherent rotational jitters of the photosensitive bodies 11, or an image quality failure may occur due to shear in printing caused by the relative positional variation between the photosensitive bodies 11.

In order to prevent the shear in printing, each of the photosensitive bodies 11 is supported rotatably by the box 29 of the printer 1, as shown in FIG. 7.

That is, the base end of the rotational shaft of each photosensitive body 11 (or the innermost end of the printer 1) is coupled and supported to the drive shaft of the drive motor 25 securely fixed to the box 29 via the coupling 26 axially and removably. The front side of the rotational shaft of each photosensitive body 11 (on the side of the door of the printer 1) is located to the same integral supporting plate (photosensitive supporting part) 28 while being rotatably supported by means of the bearing part 27. The integral supporting plate 28 is securely fixed to the box 29 by means of parts (not shown).

As described above, since both ends of the rotational shaft of each photosensitive body 11 are supported rotatably, the pitch (interval) of the base ends of the rotational shafts of the photosensitive bodies 11 is accurately determined by means of the couplings 26 on the side of the drive motor 25 while the pitch (interval) of the front ends of the rotational shafts of the photosensitive bodies 11 is accurately determined by means of holes (not shown) for rotational shafts formed in the integral supporting plate 28.

In such a manner, occurrence of shear in printing can be prevented because the rotational shafts of the photosensitive bodies 11 are mutually arranged in parallel and at equal intervals.

In order to replace the photosensitive bodies 11 supported as shown in FIG. 7, the integral supporting plate 28 is disassembled from the box 29. Then four photosensitive bodies 11 are withdrawn from the box 29 at the same time, with the photosensitive bodies 11 mutually fixed by the integral supporting plate 28. In this case, the base end of the rotational shaft of each photosensitive body 11 is separated from the drive system (the drive shaft of the drive motor 25) at the position of the coupling 26. Then all the bearing parts 27 are removed and the integral supporting plate 28 is removed away from the front ends of four photosensitive bodies 11. In such a state, any one of the photosensitive bodies 11 is replaced.

After the replacement, the photosensitive body 11 is securely re-fixed to the box 29 according to the procedure reversed to the above-mentioned procedure. That is, the integral supporting plate 28 is mounted on the front ends of the four photosensitive bodies 11. The front end of the rotational shaft of each photosensitive body 11 is attached to the integral supporting plate 28 by means of the bearing part 27. The four photosensitive bodies 11 united are housed in the box 29. The base ends of the rotational shafts of the four photosensitive bodies 11 are engaged with the couplings 26 while the integral supporting plate 28 is securely fixed to the box 29.

However, in the above-mentioned color image forming device (electro-photographic printer 1), since a piece of the integral supporting plate 28 supports the front ends of the rotational shafts of the four photosensitive bodies 11, all the photosensitive bodies 11 must be disassembled even when only one photosensitive body 11 is replaced. As a result, the replacement of the photosensitive body 11 is very troublesome.

In the changing work, as described above, after a photosensitive body 11 is replaced by removing once all the photosensitive bodies 11, installation work of the integral supporting plate 28 must be done while the four photosensitive bodies 11 are handled. It is difficult for one person to perform the installation work. In addition, the changing procedure of the photosensitive body 11 is very complicated because the centers of the shafts of the photosensitive bodies 11 must be agreed in phase.

Therefore, it has been difficult that an operator with no trained experience about only the operation of the electro-photographic printer 1 exchanges the photosensitive body 11. Usually, replacement of the photosensitive body 11 is done by a maintenance personnel trained about only the operation of the electro-photographic printer 1.

For that reason, it has long been waited that even an operator with no special trained experience can easily replace the photosensitive bodies 11 one by one without incurring any print quality deterioration associated with the shear in printing.

SUMMARY OF THE INVENTION

The present invention is made to overcome the above mentioned problems. An object of the present invention is to provide a color image forming device in which the image forming carriers (photosensitive bodies) can be easily replaced one by one by an operator with no special trained experience, without inviting deterioration in print quality associated with shear (shift) in printing.

In order to achieve the above objects, according to the present invention, the color image forming device wherein a color image is formed on a sheet-like medium by transferring sequentially a manifest image of each color developed on each of image forming carriers to the sheet-like medium, the color image forming device having a box in which the image forming carriers are arranged so as to parallelize nearly rotational shafts of the image forming carriers, the forming carriers being driven respectively and rotatably, is characterized by a positioning and fixing implement coupled removably to the front end of the rotational shaft of each of the image forming carriers in the axial direction, for positioning and fixing to the box while the front end of the rotational shaft is supported rotatably, the positioning and fixing implement being arranged to each of the image forming carriers; and a coupling for coupling detachably the base end of the rotational shaft of each of the image forming carriers with a drive system fixed to the box in the axial direction, the coupling being arranged to each of the image forming carriers.

Positioning protuberances are arranged respectively on the fringe portions of openings formed in the box through which the image forming carriers can be passed respectively, the positioning protuberances protruding outwards. The positioning and fixing implement has a positioning member and a fixing member, as described later. The positioning member positions the front end of the rotational shaft of each of the image forming carriers by respectively penetrating the positioning protuberances into positioning holes, the positioning member having a bearing which is coupled removably to the front end of the rotational shaft of each of the image forming carriers in the axial direction and which supports the front end of the rotational shaft rotatably, the positioning member having the positioning holes through which the positioning protuberances can be respectively passed. The fixing member fixes the positioning member to the box while the positioning protuberances penetrate the positioning holes in the positioning member.

An enlarged portion is formed on the front end of each of the positioning protuberances. The positioning member is fixed to the box when the fixing member is coupled externally and rotatably to the positioning member, is rotated to the positioning member, with the positioning protuberances penetrating the positioning holes formed in the positioning member, and then is fitted between the enlarged portion of each of the positioning protuberances and the fringe portion of each of the positioning holes in the positioning member.

A force applying mechanism that applies force axially to the image forming carrier toward the coupling may be arranged. A force applying spring may be arranged to each of said positioning members to apply force axially to the rotational shaft of each of the image forming carriers toward the coupling via the bearing.

In the coupling, the force point at which a drive force is transmitted to the rotational shaft and the fulcrum supporting the base end of the rotational shaft are arranged nearly at the same position in the axial direction.

Moreover, all positions at which the couplings couple respectively the rotational shafts with the drive systems on the side of the base ends of the image forming carriers may be arranged nearly in the first reference plane perpendicular to the rotational shafts. All positions at which the rotational shafts are respectively supported rotatably by means of the positioning and fixing implements on the side of the front ends of the image forming carriers are arranged nearly in the second reference plane perpendicular to the rotational shafts.

In this case, the first reference plane corresponds to the side surface of the box on the side of the base ends of the image forming carriers. The second reference plane corresponds to the side surface of the box on the side of the front ends of the image forming carriers.

In the color image forming device with the above-mentioned configuration according to the present invention, image forming carriers can be disassembled one by one by merely releasing the state fixed by means of the positioning and fixing implement mounted on each image forming carrier. A new image forming carrier is positioned and fixed to the box by means of the positioning and fixing implement by supporting rotatably the front end of the rotational shaft while the base end of the rotational shaft of the new image forming carrier is coupled to the drive system by means of each coupling. In such a manner, the image forming carriers can be replaced one by one.

By using positioning protuberances arranged to a box and a positioning/fixing implement formed of a positioning member and a fixing member, each of image forming carriers can be positioned and fixed as follows. That is, while the front end of the rotational shaft of an image forming carrier is supported rotatably by the bearing of the positioning member, the protuberances penetrate respectively positioning holes in the positioning member. Thus the positioning member is fixed to the box by means of the fixing member after positioning the front end of the rotational shaft of the image forming carrier.

By forming an enlarged portion in the front end of each protuberance and using a fixing member coupled rotatably to the above-mentioned positioning member, the positioning member can be fixed by means of the fixing member as follows. That is, the fixing member is rotated with respect to the positioning member while positioning with the positioning member is made by penetrating each protuberance to each hole. The fixing member is fitted between the enlarged portion of each positioning protuberance and the fringe portion of each positioning hole in the positioning member. Thus the positioning member is fixed to a box.

The image forming carrier is pressed against the coupling (drive system) by axially applying force to it toward the coupling by means of a force applying mechanism. Thus, the base end of the rotational shaft can be surely coupled to the drive system.

Similarly, since the force applying spring arranged to the positioning member applies force axially to the rotational shaft of an image forming carrier toward the coupling via a bearing, the image forming carrier is pressed against the coupling (drive system). Thus the base end of the rotational shaft can be coupled surely to the drive system. Further, since the fixing member presses the enlarged portion of the front end of the protuberance via the positioning member by the counter force of the force applying spring, the fixing member can surely hold the fixed state.

Occurrence of the rotational jitters due to an axial shift between the drive shaft of the drive system and the rotational shaft of the image forming carrier can be prevented by axially arranging the force point and the fulcrum nearly at the same position in the axial direction in the coupling.

Moreover, occurrence of rotational jitters due to parallel shift of each of image forming carriers can be prevented by arranging all the coupling positions of the couplings nearly in the first reference plane (e.g. the side surface of a box on the side of the base ends of image forming carriers) perpendicular to the rotational shaft.

Likewise, occurrence of rotational jitters due to parallel shift of each of image forming carriers can be prevented by arranging all the positions supported rotatably by the positioning/fixing implements nearly in the second reference plane (e.g. the side surface of a box on the side of the front ends of image forming carriers) perpendicular to the rotational shaft.

As described above, according to the color image forming device of the present invention, even an operator with no specially-trained experience can replace the image forming carriers one by one through a very simple procedure.

The base end of the rotational shaft of the image forming carrier can be surely coupled with the drive system by applying force to the image forming carrier toward the coupling by means of the force applying mechanism or force applying spring and the image forming carriers can be driven stably and rotatably by means of the driving system. This feature contributes to reserving the print quality. Moreover, since the fixing member is pressed to the enlarged portion of the protrudent front end by the counter force of the force applying spring and the fixing member can certainly hold the fixed state, it can be prevented that the fixing member rotates due to vibrations or other factors and its fixed state is released unintentionally.

Since the force point and the fulcrum in the coupling are axially arranged nearly at the same position, occurrence of the rotational jitters associated with an axial shift between the rotational shaft and the drive shaft in the drive system can be certainly prevented in each of the image forming carriers. This feature contributes to a reservation of the print quality.

Furthermore, all the coupled positions of couplings are set nearly in the first reference plane perpendicular to the rotational shaft and all the positions supported by the positioning/fixing implements are set nearly in the second reference plane perpendicular to the rotational shaft. Thus occurrence of the rotational jitters caused by the parallel shift of each of the image forming carriers can be surely prevented. This feature contributes to a reservation of the print quality.

As described above, according to the color image forming device of the present invention, even an operation with no specially-trained experience can easily replace image forming carriers one by one, without inviting any print quality degradation due to shear in printing.

DESCRIPTION OF THE PREFERRED EMBODIMENTS

Let us explain an embodiment of the present invention with reference to the attached drawings.

Figure 1:
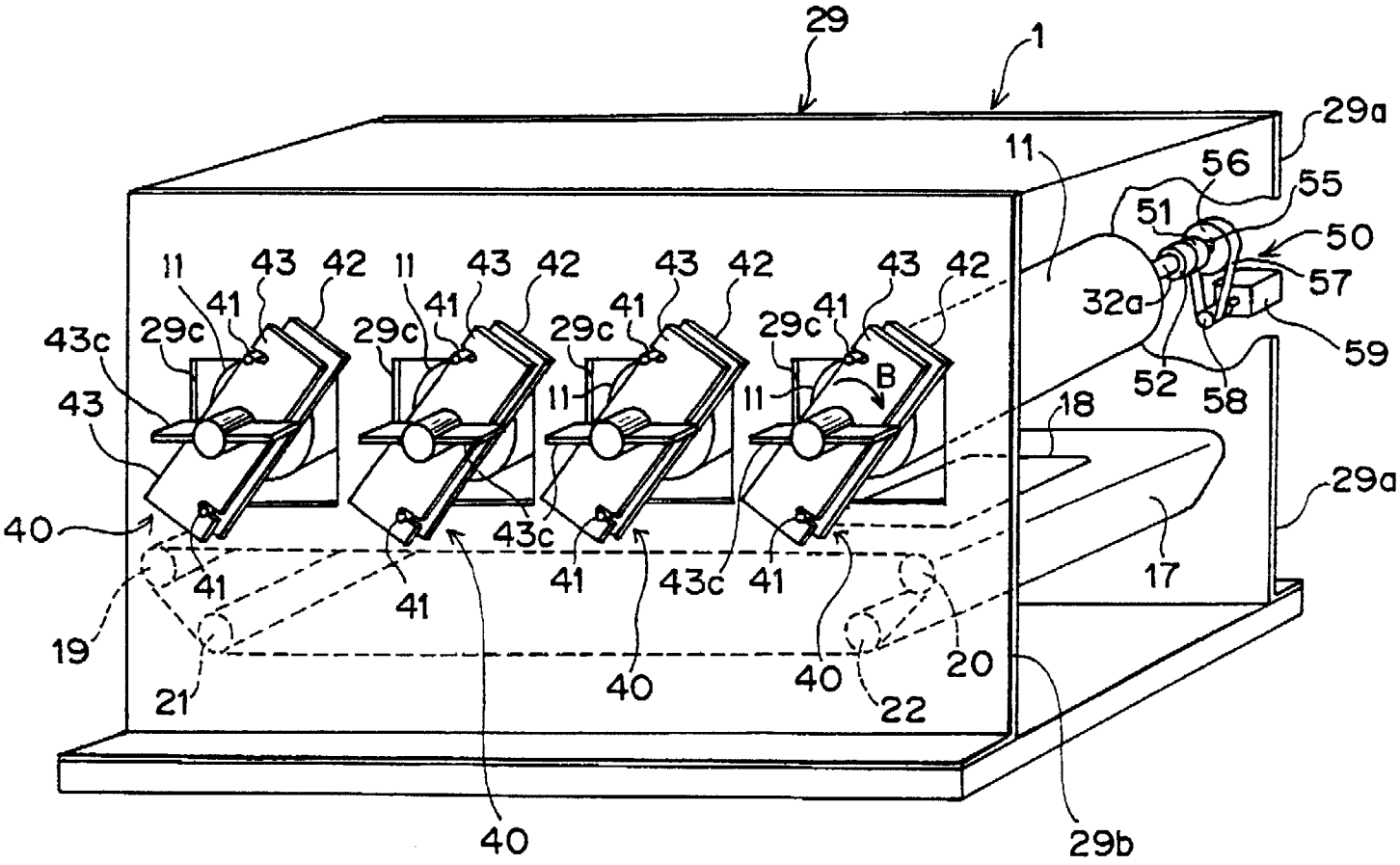
FIG. 1 is a perspective view, including a partially broken part, schematically illustrating a photosensitive body (image forming carrier) mounted on a box in a color image forming device, according to an embodiment of the present invention.
Figure 2:
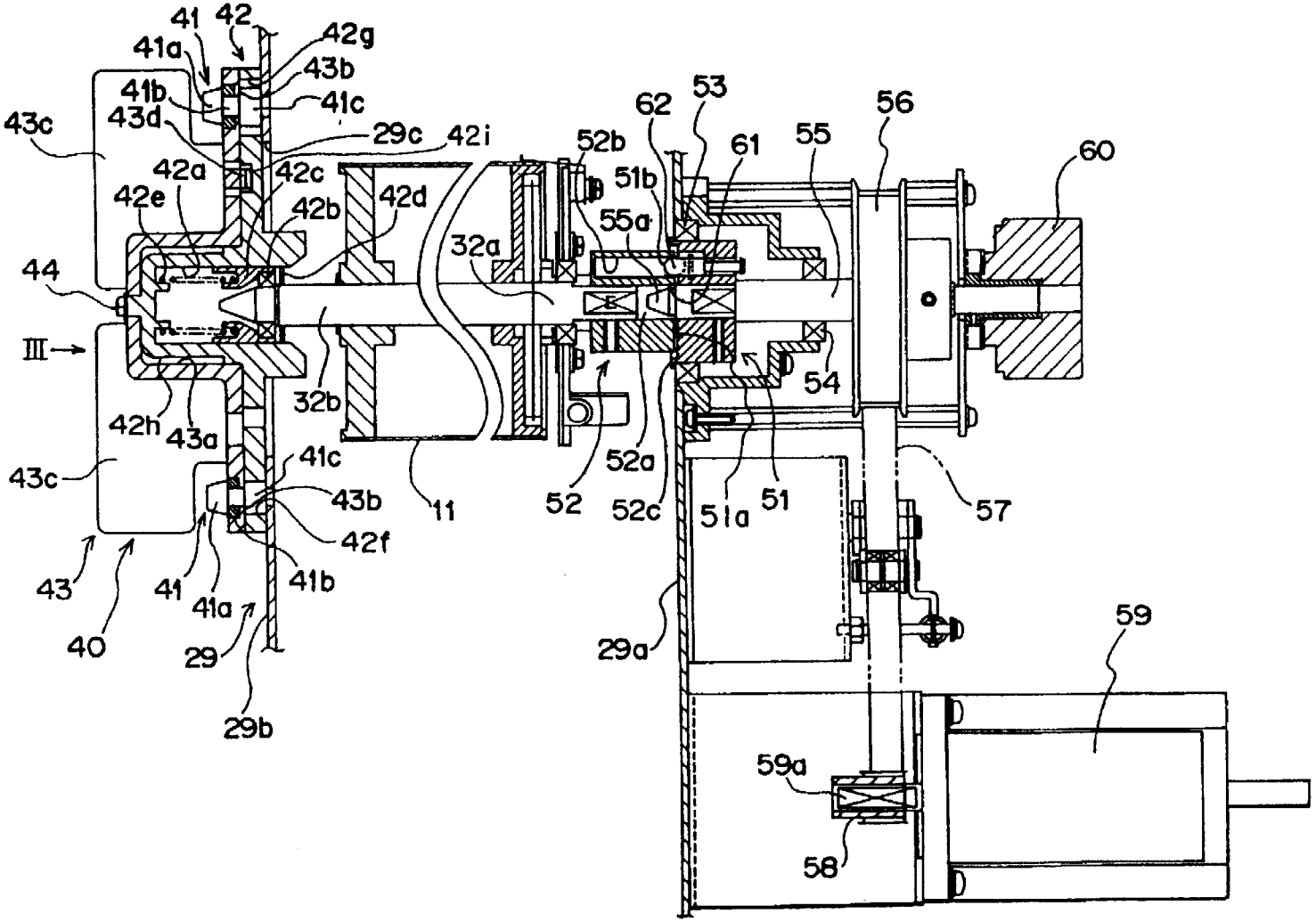
FIG. 2 is a cross sectional view illustrating the structure of the main portion according to the present embodiment.
Figure 3:
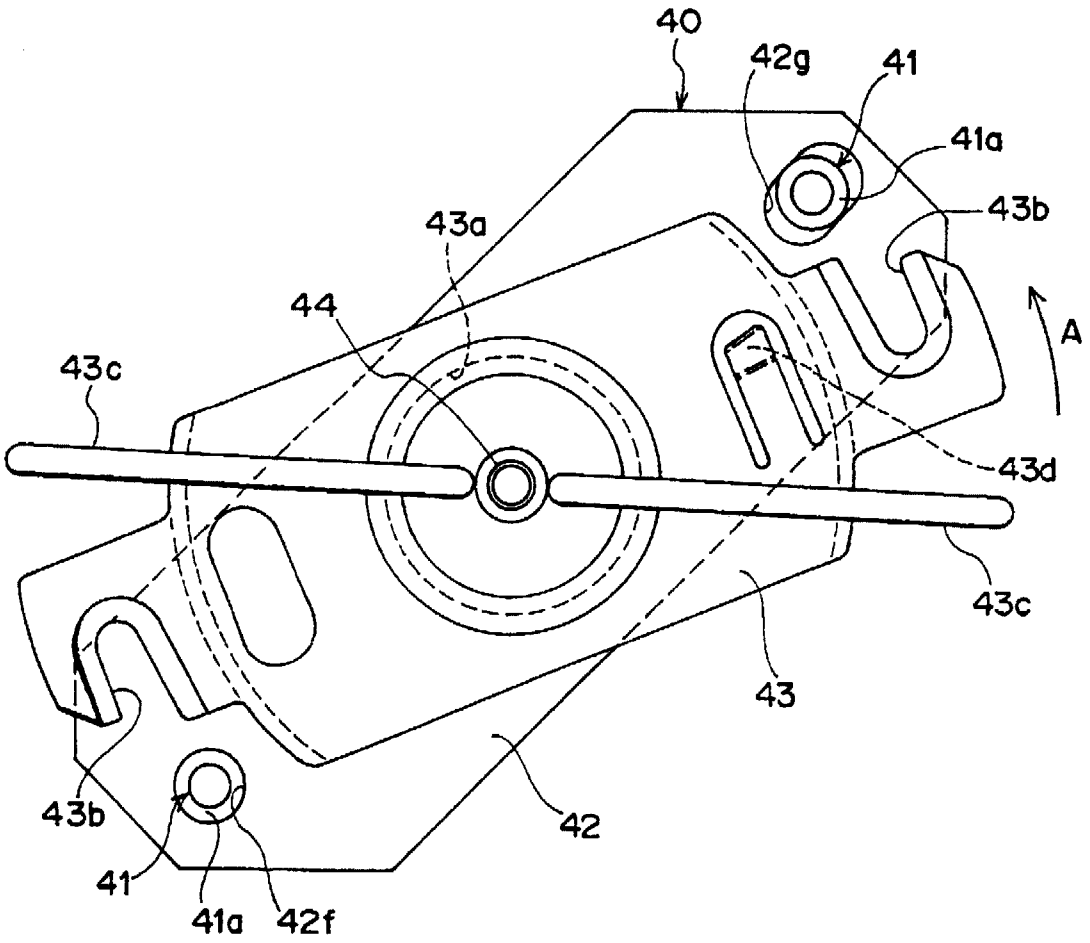
FIG. 3 is a plan view (a view taken in the direction of arrow III in FIG. 2) illustrating a positioning and fixing implement according to the present embodiment.
Figure 4:
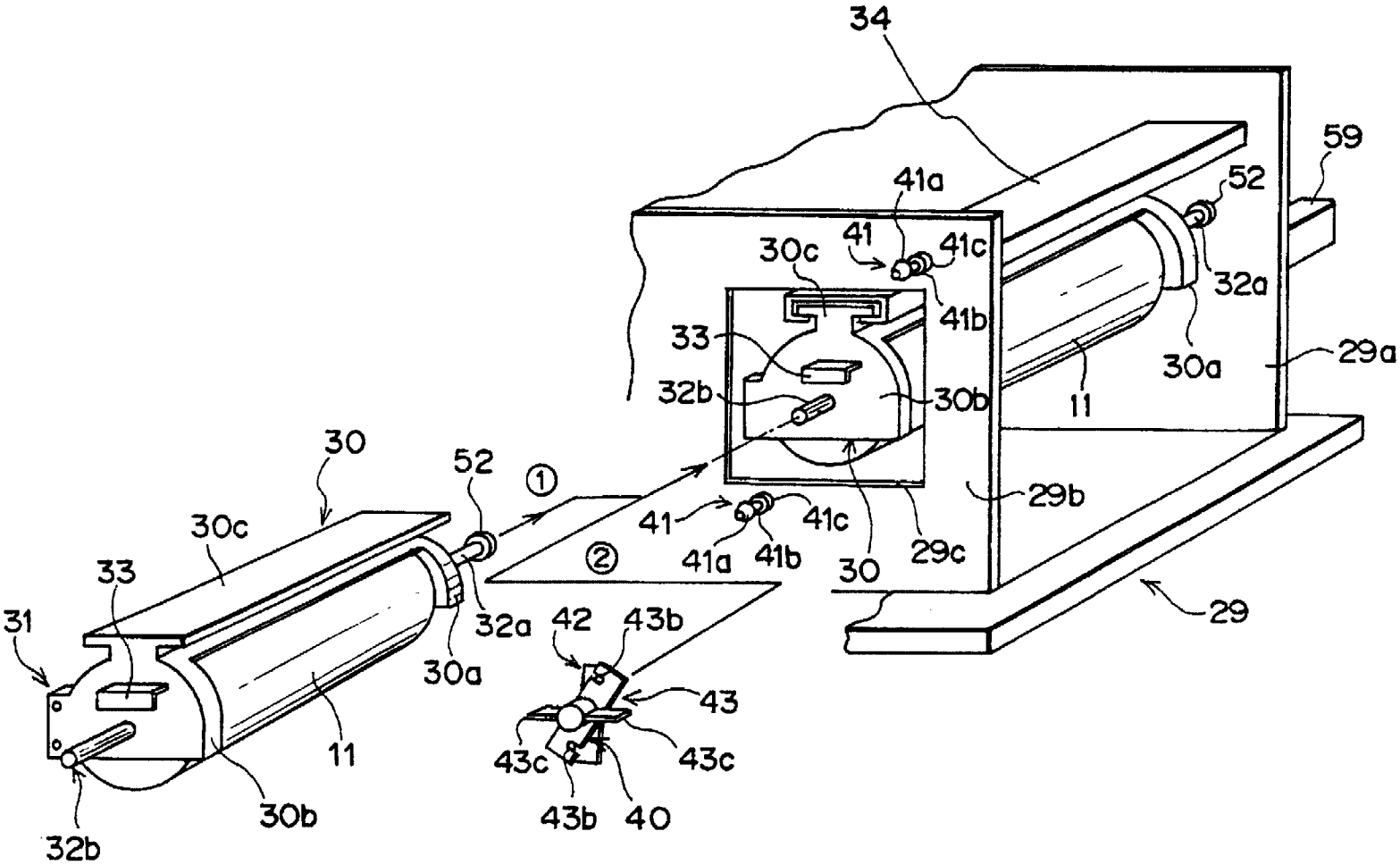
FIG. 4 is a schematic, disassembled perspective view used for explaining the procedure of mounting a photosensitive body (image forming carder) on a box, according to the present embodiment.
Figure 5:
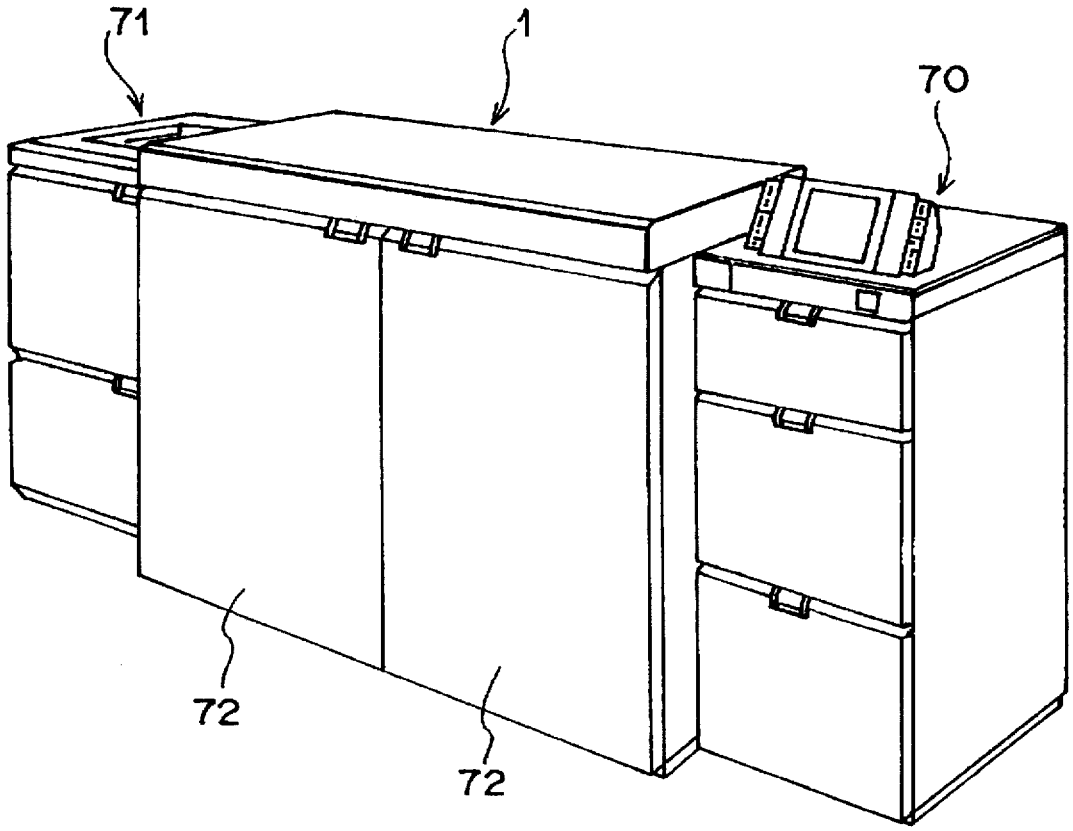
FIG. 5 is a perspective view showing the external appearance of a color image forming device according to the present embodiment.

FIGS. 1 to 5 are used to explain a color image forming device according to an embodiment of the present invention. FIG. 1 is a perspective view, including a partially broken part, schematically illustrating a photosensitive body (image forming carrier) mounted on a box. FIG. 2 is a cross sectional view illustrating the structure of the main portion. FIG. 3 is a plan view (a view taken in the direction of arrow III in FIG. 2) illustrating the positioning and fixing implement. FIG. 4 is a schematic, disassembled, perspective view used for explaining the procedure of mounting the photosensitive body (image forming carrier) on a box. FIG. 5 is a perspective view illustrating the external appearance of a color image forming device.

Figure 6:
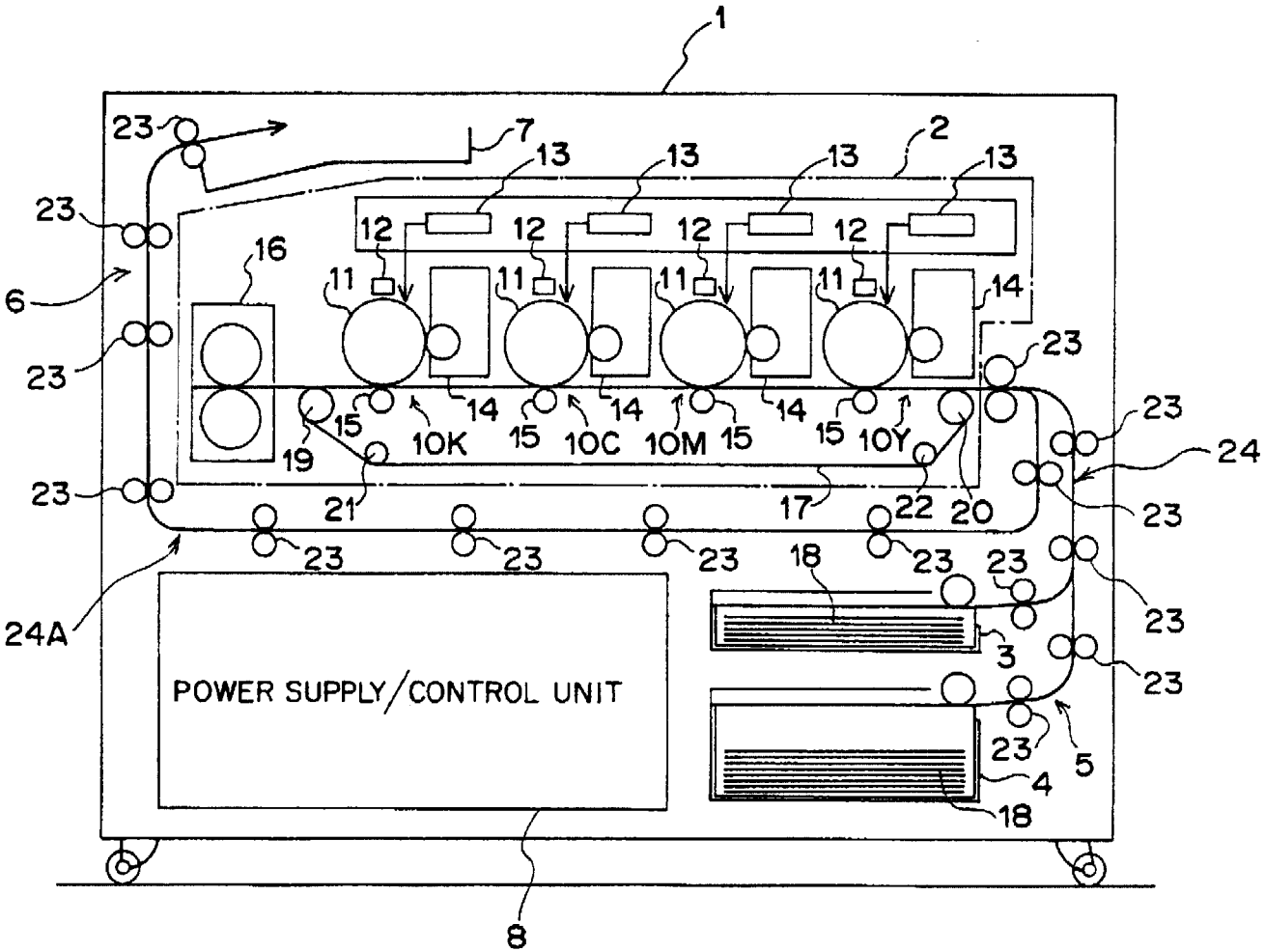
FIG. 6 is a side sectional view schematically showing the internal structure of a general color image forming device.

The color image forming device according to the present embodiment has nearly the same structure as that of the electro-photographic printer 1 shown in FIG. 6. The printer 1 according to the present embodiment will be explained by extracting the main portion (the feature of the present invention) thereof and by referring to FIGS. 1 to 5. In FIGS. 1 to 5, like numerals are attached to the same elements as those before-explained with FIGS. 6 and 7. Hence, detail explanation on the same elements will be omitted here.

The photosensitive body (image forming carrier) 11 of the present embodiment, as shown in FIG. 4, is integrally united together with a cleaning mechanism 31 that removes toner left on the surface of the photosensitive body 11 to complete the photosensitive drum unit 30. On the ends of the photosensitive body 11, the rotational shaft 32*a* for the base end side is supported rotatably on the wall 30*a* of the unit 30 while the rotational shaft 32*b* for the front end side is supported rotatably on the wall 30*b* of the unit 30.

In order to withdraw the unit 30 from the interior of the box 29 or to insert it into the box 29, the handle 33 gripped by an operator is mounted on the outer surface of the wall 30*b* of the unit 30. A square opening 29*c* through which the photosensitive body 11 can pass is formed in the side wall (side surface) 29*b* of the box 29 on the side of the front end of the photosensitive body 11 (on the side of the door of the printer 1 (refer to numeral 72 in FIG. 5)).

Further, a rail 30*c* with a T-shaped cross section is formed on the upper surface of the unit 30. A guide 34 is fixed between the side wall 29*b* and the side wall (side surface) 29*a* of the box 29 on the side of the base end of the photosensitive body 11 (or on the innermost side of the printer 1) to guide axially the rail 30*c* of the unit 30. When the unit 30 is taken out of the box 29 or inserted into the box 29, it is guided axially by engaging the rail 30*c* of the unit 30 with the guide 34 in the box 29.

The side walls 29*a* and 29*b* of the box 29 are perpendicular to the guiding direction (axial direction) of the rotational shafts 32*a*, 32*b* and the guide 34 of each photosensitive body 11. Each of four photosensitive bodies 11 shown FIG. 1 is formed as the unit 30 shown in FIG. 4 and is guided along the guide 34. In FIGS. 1 and 2, only the photosensitive body 11 of the photosensitive drum unit 30 is shown. The main body of the photosensitive drum unit 30 and the guide 34 within the box 29 are omitted here in FIGS. 1 and 2.

In the present embodiment, a photosensitive body (photosensitive drum) 11 is arranged in each of the printing units 10Y, 10M, 10C and 10K, as shown in FIG. 1. In four photosensitive bodies 11, the rotational shafts 32*a* and 32*b* are arranged nearly in parallel within the box 29 and are respectively rotated by means of the drive system 50. FIG. 1 illustrates only the portion characterized by the present invention (portion concerning the photosensitive body 11). The portions other than the photosensitive bodies 11 forming the printing units 10Y, 10M, 10C and 10K are not illustrated.

In the present embodiment, as shown in FIGS. 1 and 2, a positioning/fixing implement 40 which is axially and removably connected to the front end of the rotational shaft 32*b* of the photosensitive body 11 is arranged in each photosensitive body 11 to locate and fix to the box 29 while rotatably supporting the rotational shaft 32*b*. The couplings 51 and 52 are arranged to each photosensitive body 11 to couple axially and detachably the base end of the rotational shaft 29*a* of the photosensitive body 11 with drive system 50 fixed on the box 29.

The coupling 51 on the drive system side, as shown in FIG. 2, is supported rotatably to the innermost side wall 29*a* of the box 29 via the bearing 53. The drive system side coupling 51 is fixed to the front end of the drive shaft 55 in the drive system 50.

The drive system 50 is formed of a drive shaft 55, a pulley 56, a timing belt 57, a pulley 58, and a drive motor 59. That is, the timing belt 57 is wound around the pulley 56 coaxially coupled to the drive shaft 55 and the pulley 58 coaxially coupled to the drive shaft 59*a* of the drive motor 59. The rotational drive force of the drive motor 59 is transmitted to the coupling 51 on the drive system side via the drive shaft 59*a*, the pulley 58, the timing belt 57, the pulley 56 and the drive shaft 55.

The drive shaft 55 is supported rotatably to the side wall 29*a* of the box 29 via the bearing 54. The drive motor 59 is fixed to the box 29. The rotary encoder 60 that detects a rotational angle of the drive shaft 55 is connected to the drive shaft 55 (the rotational shaft of the pulley 56). The rotary encoder 60 is fixed to the box 29.

On the other hand, the photosensitive body side coupling 52 is coupled to the front end of the base end side rotational shaft 32*a* of the photosensitive body 11. The photosensitive body side coupling 52 is coupled axially and detachably to the drive system side coupling 51.

The end surface 51*a* of the drive system side coupling 51 on the side of the photosensitive body 11 is arranged so as to make nearly a flat-topped surface to the inner surface (the surface of the photosensitive body 11 side) of the side wall 29*a* of the box 29. The engaging member 51*b* which engages with the photosensitive body side coupling 52 is mounted so as to protrude axially from the end surface 51*a* toward the photosensitive body 11. Further, the end 55*a* of the drive shaft 55 protrudes from the end surface 51*a* toward the photosensitive body 11.

In the coupling state with the coupling 51 on the drive system side (the state shown in FIG. 2), a fitting hole 52*a* which receives the end 55*a* of the drive shaft 55 and an engaging hole 52*b* which engages with the engaging member 51*b* are axially formed in the coupling 52 on the side of the photosensitive body.

With the front end 55*a* of the drive shaft 55 fitted with the fitting hole 52*a* of the photosensitive body side coupling 52, the portion where the front end 55*a* is in contact with the fitting hole 52*a* (the inner fringe of the fitting hole 52*a* at the position of the end surface 52*c*) acts as a fulcrum 61 supporting the base end side rotational shaft 32*a* of the photosensitive body 11. Further, with the engaging member 51*b* engaged with the engaging holengaging hole 52*b* of the photosensitive body side coupling 52, the portion where the engaging member 51*b* is in contact with the inner peripheral surface of the engaging hole 52*b* acts as a force point 62 transmitting the drive force from the drive system 50 to the base end side rotational shaft 32*a* of the photosensitive body 11.

In the present embodiment, the fulcrum 61 and the force point 62 described above are arranged nearly at the same position in the axial direction, for example, the position of the side wall 29*a* of the box 29 as shown in FIG. 2. All positions at which the couplings 51, 52 couple the rotational shaft 32*a* with the drive system 50 on the base side of each photosensitive body 11 are arranged nearly in the side wall 29*a* of the box 29 (on the first reference surface perpendicular to the rotational shaft 32*a*, the side surface of the box 29).

The positioning/fixing implement 40 is formed of as shown in FIGS. 1 to 4. In the present embodiment, two positioning pins (positioning protuberances) 41 each which locates the photosensitive body 11 by cooperating with the positioning/fixing implement 40 protrude outward from the side wall 29*b* of the box 29. The positioning pins 41 are arranged at the upper and lower positions to the opening 29*c* which is formed to allow a passage of the photosensitive body 11. A groove (enlarged portion having a smaller diameter than other portions) 41*b* is vertically formed in the middle portion of each positioning pin. The front end portion and the base end portion is formed as enlarged portions 41*a* and 41*c* respectively.

The positioning/fixing implement 40 is formed of a positioning member 42 and a fixing member 43 described later.

A recessed portion 42*a* at which the front end rotational shaft 32*b* of the photosensitive body 11 is axially inserted is formed in the positioning member 42. A bearing 42*b* which is detachably coupled to the front end side rotational shaft 32*b* and which supports rotatably the rotational shaft 32*b* is slidably housed in the axial direction inside the recessed portion 42*a* while being held by the bearing supporting member 42*c*. A regulating member 42*d* regulates the bearing 42*b* and the bearing supporting member 42*c* moving in the axial direction. The regulating member 42*d* prevents the bearing 42*b* and the bearing supporting member 42*c* from being dropped out of the recessed portion 42*a*.

A force applying spring (force applying mechanism) 42*e* that applies force to the bearing 42*b* toward the photosensitive body 11 is inserted between the positioning member 42 and the bearing supporting member 42*c* within the recessed portion 42*a*. The force applying spring 42*e* allows the rotational shafts 32*b* and 32*a* of the photosensitive body 11 to be axially applied force toward the couplings 52 and 51 via the bearing 42*b* at the event of mounting the photosensitive body 11.

Further, the positioning hole 42*f* and the positioning long hole 42*g* through which two positioning pins 41 pass respectively are formed in the positioning member 42. The rotational shaft 32*b* on the front end side of the photosensitive body 11 is located by respectively penetrating the pins 41 into the holes 42*f* and 42*g*. At this time, the positioning hole 42*f* is formed so as to fit the enlarged portion 41*c* on the base side of one positioning pin 41 with no clearance in its inner periphery. The positioning long hole 42*g* is formed so as to regulate the movement of the rotational shaft 32*b* of the positioning member 42 only in the rotational direction, with other positioning pin 41 fitted. The positioning long hole 42*g* is formed so as to have somewhat a clearance in the radial direction of the rotational shaft 32*b*.

A rotation regulating groove 41*i* that is engaged with the rotation regulating protuberance 4d*d* on the side of the fixing member 43 (to be described later) and can regulate its rotational range to the positioning member 42 of the fixing member 43 is formed in the positioning member 42.

The fixing member 43 fixes the positioning member 42 to the box 29, with the positioning pins 41 (enlarged portions 41*c*) penetrated respectively into the positioning hole 42*f* and the positioning long hole 42*g* of the positioning member 42. The fixing member 43 is rotatably coupled externally to the positioning member 42 by means of a hinge 44. That is, a recessed portion 43*a* that fits with cylindrical protruded portion 42*h* of the positioning member 42 (or the portion formed outward and in conformation with the recessed portion 42*a*) is formed in the fixing member 43. The fixing member 43 is pivotally fixed to the positioning member 42 by means of the hinge 44 to rotate coaxially to the rotational shaft 32*b*, with the protruded portion 42*h* of the positioning member 42 fitted to the recessed portion 43*a*.

The fixing member 43 includes two chipped portions 43*b* (to be described later) and a handle 43*c* held by an operator to manipulate the positioning/fixing implement 40. A rotation regulating protuberance 43*d* that fits with the rotation regulating groove 42*i* of the positioning member 42 (beforementioned) and regulates the rotational range around the hinge 44 of the fixing member 43 is protrudently arranged on the side of the positioning member 42.

The two chipped portions 43*b* are formed so as to be fitted to the groove portion 41*b* for the positioning pin 41. For example, as shown in FIG. 3, when an operator holds the handle 43*c*, with the positioning pins 41 respectively penetrated into the positioning hole 42*f* and the positioning long hole 42*g*, and then rotates the fixing member 43 in the rotational direction shown by the arrow A, the positioning member 42 (or the positioning/fixing implement 40) is fixed to the box 29 by fitting the fringe portion of the chipped portion 43b of the fixing member 43 between the enlarged portion 41a and the positioning member 42 (the fringe portion of each of the holes 42f and 42g).

In the present embodiment, the position where the rotational shaft 32b on the front end side of each of the photosensitive bodies 11 is supported rotatably by means of the positioning/fixing implement 40, that is, the position of the bearing 42b (the second reference surface perpendicular to the rotational shaft 32b, the side surface of the box 29) is nearly flush with the side wall 29b of the box 29.

In the electro-photographic printer 1 having the above-mentioned configuration according to the present embodiment, when the photosensitive body 11 is mounted, the photosensitive body side coupling 52 of the front end of the base end side rotational shaft 32a, as shown in FIGS. 2 and 4, is engaged with the drive system side coupling 51. Then the photosensitive body 11 is positioned and fixed while the front end side rotational shaft 32b is rotatably supported by means of the positioning/fixing implement 40. In such a state, the rotational shaft 32a of the photosensitive body 11 is coupled to the drive shaft 55 of the drive system 50 via the couplings 51 and 52. The rotational drive force of the drive motor 59 is transmitted from the drive shaft 55 to the photosensitive body 11 via the couplings 51 and 52 and rotational shaft 32a so that each photosensitive body 11 is rotatably driven.

In the electro-photographic printer 1, when only one of four photosensitive bodies 11 is replaced, the door 72 of the electro-photographic printer 1 as shown in FIG. 5 is opened to expose the side of the front end of the photosensitive body 11 fixed using the positioning/fixing implement 40. Different from the sheet cassettes 3 and 4, a sheet storing device 70 which houses transfer paper sheets 18 and supplies them to the printer 1 is connected to the sheet supplying side of the electro-photographic printer 1 shown in FIG. 5. Different from the sheet stacker 7, a sheet stacker 71 to which a printed transfer paper sheet 18 is ejected is connected to the sheet ejecting side of the printer 1.

In the positioning/fixing implement 40 fixing a photosensitive body 11 for replacement (e.g. body 11 arranged on the most right side in FIG. 1), an operator holds the handle 43c and then rotates the fixing member 43 in the rotational direction shown with the arrow B shown in FIG. 1. Thus, as shown in FIG. 3, since the state of the positioning member 42 fixed with the fixing member 43 is released, the operator can release the fixed state of the photosensitive body 11 by means of the positioning/fixing implement 40 by pulling out the whole of the positioning/fixing implement 40 in the axial direction, with his hand holding the handle 43c.

In such a state, when an operator holds the handle 33 protruded from the wall portion 30b of the photosensitive drum unit 30 and then pulls out the whole of the photosensitive drum unit 30, the photosensitive drum unit 30 (photosensitive body 11) is separated off from the drive system 50 at the position of each of the couplings 51 and 52 and then disassembled out of the inside of the box 29, that is, the printer 1.

After the photosensitive body 11 is removed with the photosensitive drum unit 30, a new photosensitive drum unit 30 is mounted reversely to the above-mentioned procedure, as shown in FIG. 4, by inserting the rail 30c of the photosensitive drum unit 30 into the guide 34 on the side of the box 29, inserting the photosensitive drum unit 30 along the guide 34 in the axial direction, and then coupling the base side rotational shaft 32a of the photosensitive body 11 to the drive system 50 via the couplings 52 and 51. In this state, the base end side rotational shaft 32a of the photosensitive body 11 is located.

Thereafter, the positioning and fixing operation is performed to the box 29 of the photosensitive body 11 by mounting the positioning/fixing implement 40 to the front end side rotational shaft 32b of the photosensitive body 11.

That is, an operator first penetrates two positioning pins 41 into the positioning hole 2f and the positioning long hole 42g of the positioning member 42 while the front end side rotational shaft 32b of the photosensitive body 11 is supported rotatably with the bearing 42b of the positioning member 42. The enlarged portion 41c of the base end portion of the positioning pin 41, as shown in FIG. 3, is fitted to each of the holes 42f and 42g. In this state, the front end side rotational shaft 32b of the photosensitive body 11 is positioned.

With the positioning pins 41 fitted respectively to the positioning hole 42f and the positioning long hole 42g described above, an operator fixes the positioning member 42 (that is, the positioning/fixing implement 40) to the box 29 by rotating the fixing member 43 in the direction of the arrow A shown in FIG. 3 by holding the handle 43c while pressing the whole of the positioning/fixing implement 40 axially against the force applied by the force applying spring 42e, and then by fitting the fringe portion of the chipped portion 43b of the fixing member 43 between the enlarged portion 41a of each positioning pin 41 and the positioning member 42 (the fringe portions of the holes 42f and 42g).

At this time, according to the present embodiment, the rotational shafts 32b and 32a of the photosensitive body 11 are axially applied force toward the couplings 52 and 51 via the bearing holding member 42c and the bearing 42b by means of the force applying spring 42e arranged to the positioning member 42 so that the photosensitive body 11 is pressed to the drive system 50. Thus, the base end side rotational shaft 32a (the photosensitive body side coupling 52) is certainly coupled to the drive system 50 (the drive system side coupling 51). As a result, driving the photosensitive body 11 rotatably and stably by means of the drive system 50 contributes to reserving the print quality.

Further, since the fixing member 43 is pressed against the side of the enlarged portion 41a of the positioning pin 41 via the positioning member 42 by the counter force of the force applying spring 42e, the fixing state by means of the fixing member 43 can be certainly reserved. Moreover, it can be prevented that vibrations cause a rotation of the fixing member 43, thus releasing unintentionally the fixing state.

On the other hand, in the present embodiment, the rotational jitters which occur once per rotation due to the deviation in axial center between the drive shaft 55 of the drive system 50 and the rotational shafts 32a and 32b of the photosensitive bodies 11 can be prevented by arranging the force points 62 and the fulcrums 61 of the couplings 51 and 52 nearly at the same position in the axial direction. Hence, even if the axial center between the drive shaft 55 and the photosensitive body 11 is displaced, the rotational jitters which occur at the drive coupler (coupling portion) of each photosensitive body 11 can be certainly prevented. This feature contributes to significantly reserving the print quality.

Further, in the present embodiment, all the coupling positions (positions of the fulcrum 61 and the force point 62) of the couplings 51 and 52 in four photosensitive bodies 11 are arranged substantially in the plan surface (the side wall portion 29*a* of the box 29) perpendicular to the rotational shafts 32*a* and 32*b* while all the supported positions (the position of the bearing 42*b*) of the positioning/fixing implements 40 in four photosensitive bodies 11 are arranged substantially in the plan surface (the side wall 29*b* of the box 29) perpendicular to the rotational shafts 32*a* and 32*b*. That is, both ends of the rotational shafts of four photosensitive bodies 11 are supported within the same plane (the side wall portions 29*a* and 29*b*) perpendicular to the axial direction.

The axial center of the drive shaft 55 of the drive system 50 formed of parts may cause rotational jitters because of a shift in squareness with respect to the side surfaces (side wall portions 29*a* and 29*b*) of the box 29 by an assembling tolerance. However, as described above, since the positions coupled by the couplings 51 and 52 are set nearly in the side wall 29*a* perpendicular to the rotational shafts 32*a* and 32*b*, the rotational jitters due to the shift of the squareness can be prevented.

Figure 7:
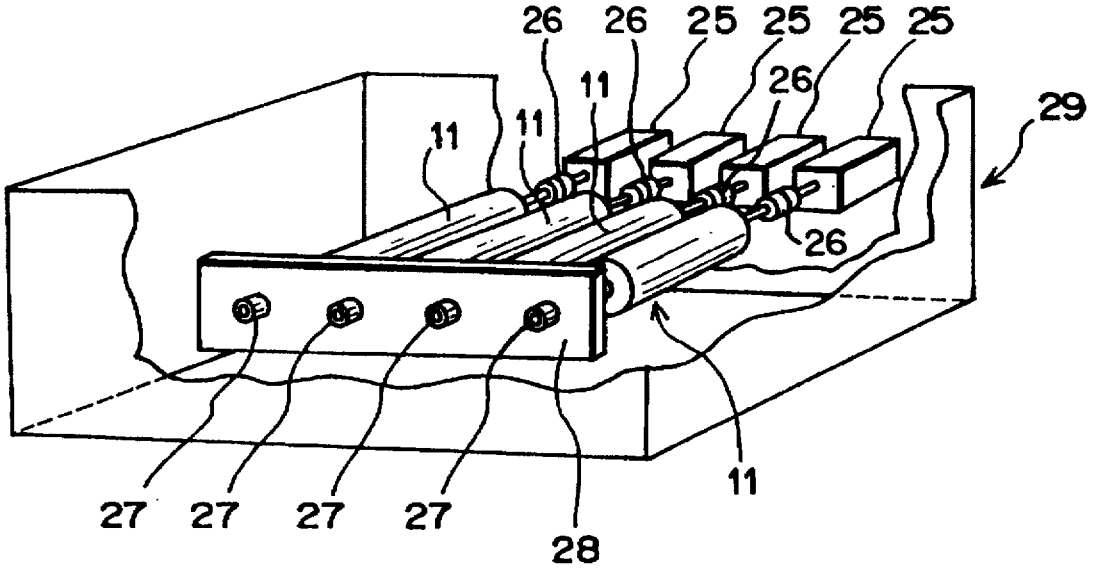
FIG. 7 is a perspective view, including a partially-broken part, schematically showing the box of the general image forming device to explain the structure supporting the photosensitive bodies (image forming carriers) therein.

Moreover, since all the positions supported rotatably by the positioning/fixing implements 40 are set nearly in the side wall 29*b* perpendicular to the rotational shafts 32*a* and 32*b*, the pitch (interval) of the front end side rotational shafts 32*b* of the photosensitive bodies 11 can be positioned with the same accuracy as that of the integral structure shown in FIG. 7.

Therefore, occurrence of the rotational jitters due to the parallel deviation of each photosensitive body 11 can be surely prevented by supporting respectively both the ends of the rotational shafts of four photosensitive bodies 11 within the side wall portions 29*a* and 29*b* perpendicular to the axial direction. This feature leads certainly to sequeing the print quality.

As described above, according to the embodiment of the present invention, since even an operator with no special trained experience can easily remove or reassemble the photosensitive body 11 with one-touch operation of the positioning/fixing implement 40, without inviting any degradation in print quality due to the print shift, the photosensitive bodies 11 can be respectively replaced very easily.

It has been explained that the above-mentioned embodiment includes four photosensitive bodies 11 and two positioning pins 41. However, it should be noted that the present invention is not limited only to the number of elements described above.

Further, in the above-mentioned embodiment, it has been explained that the force applying spring 42*e* acting as a mechanism applying forces to the photosensitive body 11 is arranged on the side of the positioning member 42. However, the present invention should not be limited only to the above-mentioned embodiment. The force applying mechanism may be mounted on the side of the photosensitive body 11.

Furthermore, in the above-mentioned embodiment, it has been explained that the side walls 29*a* and 29*b* of the box 29 are the first and second reference plan surfaces respectively and that the coupling position of the couplings 51 and 52 and position supported rotatably by the positioning/fixing implement 40 are arranged nearly in the side wall 29*a* and 29*b* of the box 29 respectively. However, the first and second reference plain surfaces should not be limited only to the side walls 29*a* and 29*b*. It is sufficient that first and second reference plain surfaces are the surface perpendicular to the rotational shafts 32*a* and 32*b* of the photosensitive body 11.

What is claimed is:

1. A color image forming device wherein a color image is formed on a sheet-like medium by transferring sequentially a manifest image of each color developed on each of image forming carriers to said sheet-like medium, said color image forming device having a housing in which said image forming carriers are arranged so as to make rotational shafts of said image forming carriers substantially parallel, said image forming carriers being driven respectively and rotatably, comprising:

a plurality of positioning and fixing implements, each positioning and fixing implement independently and removably coupled to the front end of a corresponding rotational shaft of each of said image forming carriers in the axial direction, respectively, for positioning and fixing to said housing while the front end of said corresponding rotational shaft is supported rotatably; and a plurality of couplings, each coupling independently and detachably coupling the base end of said corresponding rotational shaft of each of said image forming carriers with a corresponding drive system of a plurality of drive systems fixed to said housing in the axial direction.

2. The color image forming device according to claim 1, wherein all positions at which said couplings couple respectively said rotational shafts with said drive systems on the side of the base ends of said image forming carriers are arranged nearly in a first reference plane perpendicular to said rotational shafts.

3. The color image forming device according to claim 2, wherein said first reference plane corresponds to the side surface of said housing on the side of the base ends of said image forming carriers.

4. The color image forming device according to claim 1, wherein all positions at which said rotational shafts are respectively supported rotatably by means of said positioning and fixing implements on the side of the front ends of said image forming carriers are arranged nearly in a second reference plane perpendicular to said rotational shafts.

5. The color image forming device according to claim 4 wherein said second reference plane corresponds to the side surface of said housing on the side of the front ends of said image forming carriers.

6. A color image forming device wherein a color image is formed on a sheet-like medium by transferring sequentially a manifest image of each color developed on each of image forming carriers to said sheet-like medium, said color image forming device having a housing in which said image forming carriers are arranged so as to make rotational shafts of said image forming carriers substantially parallel, said image forming carriers being driven respectively and rotatably, comprising:

a plurality of positioning and fixing implements, each positioning and fixing implement coupled removably to the front end of a corresponding rotational shaft of each of said image forming carriers in the axial direction, respectively, for positioning and fixing to said housing while the front end of said corresponding rotational shaft is supported rotatably;

a plurality of couplings, each coupling detachably coupling the base end of said corresponding rotational shaft of each of said image forming carriers with a corresponding drive system of a plurality of drive systems fixed to said housing in the axial direction; and positioning protuberances arranged respectively on the fringe portions of openings formed in said housing through which said image forming carriers can be passed respectively, said positioning protuberances protruding outward; and wherein each of said positioning and fixing implements include a positioning member for positioning the front end of said corresponding rotational shaft of each of said image forming carriers by respectively penetrating said positioning protuberances into positioning holes, said positioning member having a bearing which is coupled removably to the front end of said corresponding rotational shaft of each of said image forming carriers in the axial direction and which supports the front end of said corresponding rotational shaft rotatably, said positioning member having said positioning holes through which said positioning protuberances can be respectively passed, and a fixing member for fixing said positioning member to said housing while said positioning protuberances penetrate into said positioning holes in said positioning member respectively.

7. The color image forming device according to claim 6, further comprising an enlarged portion formed on the front end of each of said positioning protuberances; and wherein said positioning member is fixed to said housing when said fixing member is coupled externally and rotatably to said positioning member, is rotated to said positioning member, with said positioning protuberances penetrating said positioning holes formed in said positioning member, and then is fitted between said enlarged portion of each of said positioning protuberances and the fringe portion of each of said positioning holes in said positioning member.

8. The color image forming device according to claim 7, further comprising a force applying mechanism that applies force axially to a corresponding image forming carrier toward a corresponding coupling.

9. The color image forming device according to claim 7, further comprising a plurality of force applying springs, each force applying spring respectively arranged to each positioning member of each positioning and fixing implement to apply force axially to the correspondingly rotational shaft of each of said image forming carriers toward a corresponding coupling via said bearing.

10. The color image forming device according to claim 7, wherein, in a corresponding coupling, the force point at which a drive force is transmitted to said corresponding rotational shaft and a fulcrum supporting the base end of said corresponding rotational shaft are arranged nearly at the same position in the axial direction.

11. The color image forming device according to claim 7, wherein all positions at which said couplings couple respectively said rotational shafts with said drive systems on the side of the base ends of said image forming carriers are arranged nearly in a first reference plane perpendicular to said rotational shafts.

12. The color image forming device according to claim 11 wherein said first reference plane corresponds to the side surface of said housing on the side of the base ends of said image forming carriers.

13. The color image forming device according to claim 7, wherein all positions at which said rotational shafts are respectively supported rotatably by means of said positioning and fixing implements on the side of the front ends of said image forming carriers are arranged nearly in second reference plane perpendicular to said rotational shafts.

14. The color image forming device according to claim 13 wherein said second reference plane corresponds to the side surface of said housing on the side of the front ends of said image forming carriers.

15. The color image forming device according to claim 6, further comprising a force applying mechanism that applies force axially to a corresponding image forming carrier toward coupling.

16. The color image forming device according to claim 6, wherein, in a corresponding coupling, the force point at which a drive force is transmitted to said corresponding rotational shaft and a fulcrum supporting the base end of said rotational shaft are arranged nearly at the same position in the axial direction.

17. The color image forming device according to claim 6, wherein all positions at which said couplings couple respectively said rotational shafts with said drive systems on the side of the base ends of said image forming carriers are arranged nearly in a first reference plane perpendicular to said rotational shafts.

18. The color image forming device according to claim 17, wherein said first reference plane corresponds to the side surface of said housing on the side of the base ends of said image forming carriers.

19. The color image forming device according to claim 6, wherein all positions at which said rotational shafts are respectively supported rotatably by means of said positioning and fixing implements on the side of the front ends of said image forming carriers are arranged nearly in a second reference plane perpendicular to said rotational shafts.

20. The color image forming device according to claim 19, wherein said second reference plane corresponds to the side surface of said housing on the side of the front ends of said image forming carriers.

21. A color image forming device wherein a color image is formed on a sheet-like medium by transferring sequentially a manifest image of each color developed on each of image forming carriers to said sheet-like medium, said color image forming device having a housing in which said image forming carriers are arranged so as to make rotational shafts of said image forming carriers substantially parallel, said image forming carriers being driven respectively and rotatably, comprising:

a plurality of positioning and fixing implements, each positioning and fixing implement coupled removably to the front end of a corresponding rotational shaft of each of said image forming carriers in the axial direction, respectively, for positioning and fixing to said housing while the front end of said corresponding rotational shaft is supported rotatably:

a plurality of couplings, each coupling detachably coupling the base end of said corresponding rotational shaft of each of said image forming carriers with a corresponding drive system of a plurality of drive systems fixed to said housing in the axial direction; and a force applying mechanism that applies force axially to said image forming carrier toward said coupling.

22. A color image forming device wherein a color image is formed on a sheet-like medium by transferring sequentially a manifest image of each color developed on each of image forming carriers to said sheet-like medium, said color image forming device having a housing in which said image forming carriers are arranged so as to make rotational shafts of said image forming carriers substantially parallel, said image forming carriers being driven respectively and rotatably, comprising:

a plurality of positioning and fixing implements, each positioning and fixing implement coupled removably to the front end of a corresponding rotational shaft of each of said image forming carriers in the axial direction, respectively, for positioning and fixing to said housing while the front end of said corresponding rotational shaft is supported rotatably:

a plurality of couplings, each coupling detachably coupling the base end of said corresponding rotational shaft of each of said image forming carriers with a corresponding drive system of a plurality of drive systems fixed to said housing in the axial direction; and wherein, in a corresponding coupling said coupling, the force point at which a drive force is transmitted to said corresponding rotational shaft and a fulcrum supporting the base end of said rotational shaft are arranged nearly at the same position in the axial direction.

* * * * *